US009696654B2

(12) United States Patent
Nakayama et al.

(10) Patent No.: US 9,696,654 B2
(45) Date of Patent: Jul. 4, 2017

(54) IMAGE FORMING APPARATUS COMPRISING IMAGE DENSITY DETECTOR AND TONER CONCENTRATION DETECTOR

(71) Applicants: Masayoshi Nakayama, Kanagawa (JP); Takuma Higa, Kanagawa (JP); Hiroyuki Kunii, Kanagawa (JP); Masaki Sukesako, Kanagawa (JP); Kazuaki Kamihara, Tokyo (JP); Yuichi Aizawa, Kanagawa (JP); Masahiro Katoh, Kanagawa (JP); Kohei Matsumoto, Tokyo (JP)

(72) Inventors: Masayoshi Nakayama, Kanagawa (JP); Takuma Higa, Kanagawa (JP); Hiroyuki Kunii, Kanagawa (JP); Masaki Sukesako, Kanagawa (JP); Kazuaki Kamihara, Tokyo (JP); Yuichi Aizawa, Kanagawa (JP); Masahiro Katoh, Kanagawa (JP); Kohei Matsumoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/089,275

(22) Filed: Apr. 1, 2016

(65) Prior Publication Data

US 2016/0291507 A1 Oct. 6, 2016

(30) Foreign Application Priority Data

Apr. 3, 2015 (JP) ..... 2015-076554
Apr. 23, 2015 (JP) ..... 2015-088061

(51) Int. Cl.
*G03G 15/08* (2006.01)
*G03G 15/00* (2006.01)

(52) U.S. Cl.
CPC ..... *G03G 15/0849* (2013.01); *G03G 15/0877* (2013.01); *G03G 15/5058* (2013.01); *G03G 15/556* (2013.01)

(58) Field of Classification Search
CPC ..... G03G 15/0824
(Continued)

(56) References Cited

U.S. PATENT DOCUMENTS 7,885,581 B2 * 2/2011 Oshige ..... G03G 15/0853 366/319
2006/0008281 A1 * 1/2006 Matsumoto ..... G03G 15/0848 399/27

(Continued)

FOREIGN PATENT DOCUMENTS

| | | |
|---|---|---|
| JP | 2007-078896 | 3/2007 |
| JP | 2013-097358 | 5/2013 |
| JP | 2014-149487 | 8/2014 |

*Primary Examiner* — Walter L Lindsay, Jr.
*Assistant Examiner* — Arlene Heredia Ocasio
(74) *Attorney, Agent, or Firm* — Duft Bornsen & Fettig, LLP

(57) ABSTRACT

An image forming apparatus includes an image bearer, an image forming device, a toner concentration detector, a toner supply device, an image density detector, and a controller including a memory device. At a predetermined timing before image formation is started, the controller adjusts a developing potential to adjust an image density of a detection toner image on the image bearer and drives the toner supply device or the developing device to adjust a toner concentration in the developing device. After the image formation is started, the controller drives the toner supply device to adjust the toner concentration, and, in a predetermined sheet interval, adjusts the target concentration based on the image density of the detection toner image formed in a non-image area of the image bearer. When the toner concentration is higher than the target concentration plus a (Continued)

threshold, the controller suspends image formation and readjusts the developing potential.

8 Claims, 7 Drawing Sheets

(58) Field of Classification Search
USPC ..... 399/30
See application file for complete search history.

(56) References Cited

U.S. PATENT DOCUMENTS

2006/0159474 A1* 7/2006 Suzuki ..... G03G 15/0822 399/27
2006/0210289 A1* 9/2006 Yamauchi ..... G03G 15/50 399/38
2008/0145087 A1* 6/2008 Itou ..... G03G 15/5058 399/70
2009/0214232 A1* 8/2009 Murauchi ..... G03G 15/0849 399/30
2010/0080576 A1 4/2010 Nakayama et al.
2010/0129093 A1 5/2010 Nakayama et al.
2010/0215389 A1 8/2010 Imahori et al.
2010/0272457 A1* 10/2010 Mabuchi ..... G03G 15/5041 399/49
2011/0110676 A1 5/2011 Higa
2011/0222872 A1* 9/2011 Minamikawa ..... G03G 15/0853 399/27
2011/0229173 A1 9/2011 Nakayama
2011/0229820 A1 9/2011 Higa
2011/0280594 A1* 11/2011 Tanaka ..... G03G 15/065 399/27
2013/0236200 A1* 9/2013 Tanaka ..... G03G 15/0824 399/49
2014/0064756 A1 3/2014 Sugiyama et al.
2014/0301747 A1* 10/2014 Takahashi ..... G03G 15/0921 399/30
2015/0331355 A1* 11/2015 Wada ..... G03G 15/0824 399/30
2015/0355572 A1* 12/2015 Saitoh ..... G03G 15/0824 399/30
2016/0070198 A1* 3/2016 Morinaga ..... G03G 15/553 399/27

* cited by examiner

IMAGE FORMING APPARATUS COMPRISING IMAGE DENSITY DETECTOR AND TONER CONCENTRATION DETECTOR

CROSS-REFERENCE TO RELATED APPLICATIONS

This patent application is based on and claims priority pursuant to 35 U.S.C. §119(a) to Japanese Patent Application Nos. 2015-076554, filed on Apr. 3, 2015, and 2015-088061, filed on Apr. 23, 2015, in the Japan Patent Office, the entire disclosure of each of which is hereby incorporated by reference herein.

BACKGROUND

Technical Field

The present disclosure generally relates to an electrophotographic image forming apparatus such as a copier, a facsimile machine, a printer, or a multifunction peripheral (MFP, i.e., a multifunction machine) having at least two of copying, printing, facsimile transmission, plotting, and scanning capabilities and, more particularly, to an image forming apparatus including a developing device employing two-component developer.

Description of the Related Art

Developing devices employing two-component developer including toner and carrier (hereinafter "two-component developing devices") are widely used in image forming apparatuses such as photocopiers, facsimile machines, printers, and MFPs.

In such two-component developing devices, the developer is carried on a developing roller (i.e., a developer bearer) after fully stirred in the developing device. After a developer regulator (e.g., a doctor blade) disposed facing the developing roller adjusts the amount of the developer carried on the developing roller, the developer reaches a position (i.e., a development gap) facing a photoconductor drum (i.e., an image bearer) as the developing roller rotates. In the development gap, an electrical field (developing potential) is generated between the developing roller, to which a developing bias is applied, and the photoconductor drum having a latent image potential. Then, the toner in the two-component developer adheres to a latent image on the photoconductor drum due to the electrical field.

In such image forming apparatuses, to reliably produce images having a desirable image density, so-called process control is executed, for example, after power-on or recovery from a standby mode, before the start of standard image formation. The process control is to adjust image forming conditions, such as, the developing potential (a difference between the developing bias and the latent image potential) and toner concentration (i.e., the ratio of toner in the developer contained in the developing device).

For example, a toner patch is formed on an intermediate transfer belt, the image density of the toner patch is detected, and the developing potential, the toner concentration, or both are adjusted based on the detection results.

SUMMARY

An embodiment of the present invention provides an image forming apparatus that includes an image bearer, an image forming device including a developing device to develop, with developer including toner and carrier, a latent image on the image bearer into a detection toner image, a toner concentration detector to detect a toner concentration of the developer in the developing device, a toner supply device to supply the toner to the developing device, an image density detector disposed facing a surface of the image bearer to detect an image density of the detection toner image on the image bearer, and a controller including a memory device to store a target concentration for the toner concentration and a target density for the image density of the detection toner image. The developing device includes a developer bearer disposed facing the image bearer, and the developer bearer bears the developer.

At a predetermined adjustment timing before image formation is started, the controller causes the image forming device to form the detection toner image on the image bearer, adjusts a developing potential, which is a difference between a developing bias applied to the developer bearer and a latent image potential on the image bearer, to keep the image density of the detection toner image detected by the image density detector at the target density, and drives at least one of the toner supply device and the developing device to keep the toner concentration detected by the toner concentration detector at the target concentration.

After the image formation is started, the controller drives the toner supply device to keep the toner concentration at the target concentration. At a predetermined sheet interval timing after the image formation is started, the controller causes the image forming device to form the detection toner image in a non-image area on the surface of the image bearer, adjusts the target concentration based on the detected image density of the detection toner image, and controls the toner concentration based on the adjusted target concentration. When the toner concentration is higher than the target concentration plus a threshold, the controller suspends the image formation, causes the image forming device to form the detection toner image on the surface of the image bearer, and readjusts the developing potential to keep the image density of the detection toner image at the target density.

In another embodiment, an image forming apparatus includes the image bearer, the image forming device, the toner concentration detector, the toner supply device, the image density detector, and the controller described above. The controller keeps the toner concentration at the target concentration in the above-described manner at the predetermined adjustment timing before image formation is started. At the predetermined sheet interval timing after the image formation is started, the controller adjusts the target concentration based on the detected image density of the detection toner image and controls the toner concentration based on the adjusted target concentration as described above.

The memory device further stores a minimum value of the toner concentration detected by the toner concentration detector after the image formation is started. When the toner concentration detected by the toner concentration detector is higher than the minimum value of the toner concentration plus a threshold, the controller suspends the image formation, causes the image forming device to form the detection toner image on the surface of the image bearer, and readjusts the developing potential to keep the image density of the detection toner image at the target density.

In yet another embodiment, an image forming apparatus includes the image bearer, the image forming device, the toner concentration detector, the toner supply device, the image density detector, and the controller described above. The controller keeps the toner concentration at the target concentration in the above-described manner at the predetermined adjustment timing before image formation is started. At the predetermined sheet interval timing after the image formation is started, the controller adjusts the target concentration based on the detected image density of the detection toner image and controls the toner concentration based on the adjusted target concentration as described above.

When an increase per unit time in the toner concentration detected by the toner concentration detector is greater than a threshold, the controller suspends the image formation, causes the image forming device to form the detection toner image on the surface of the image bearer, and readjusts the developing potential to keep the image density of the detection toner image at the target density.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
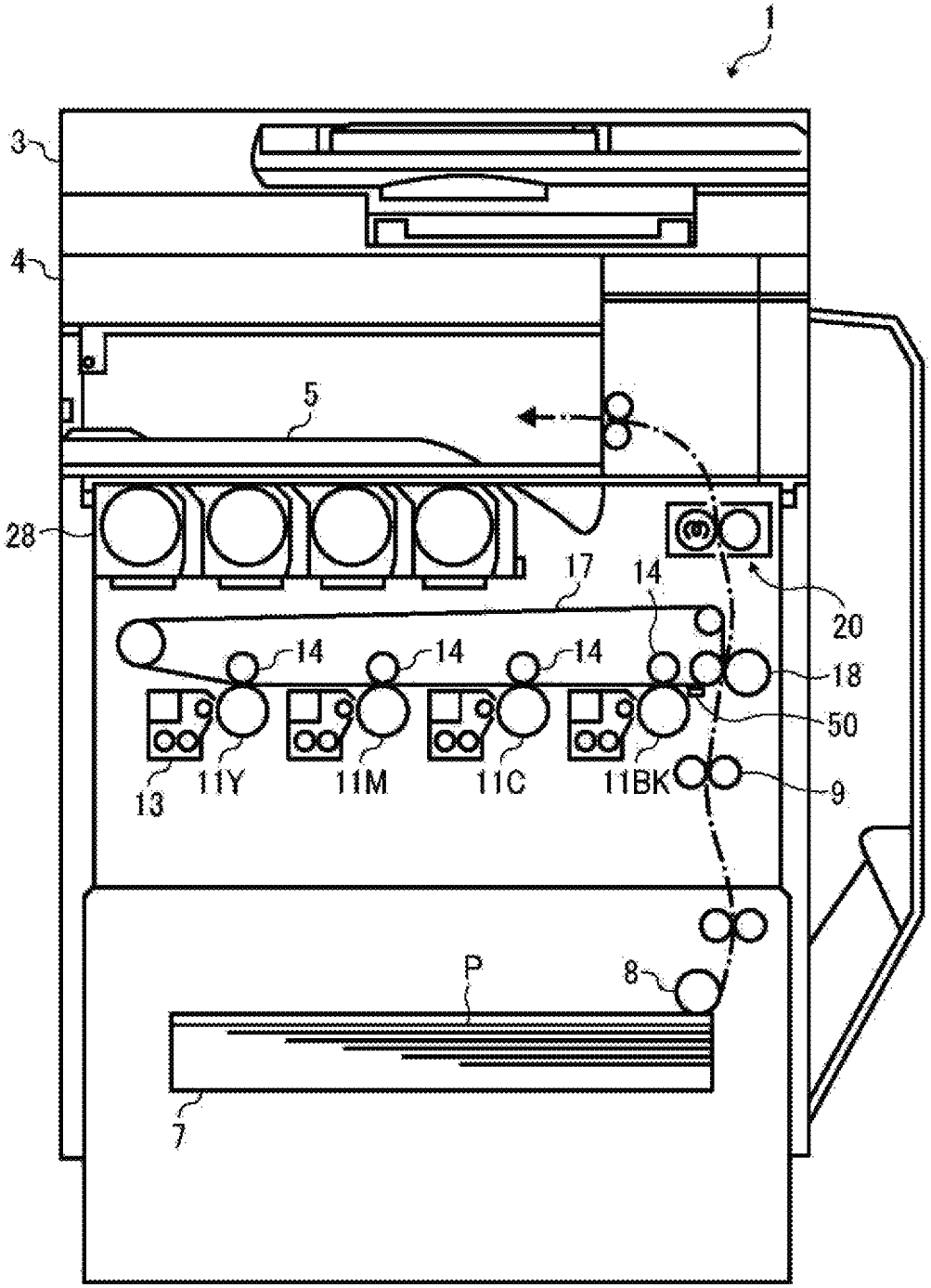
FIG. 1 is a schematic diagram illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a configuration and operation of a multicolor image forming apparatus 1 according to an embodiment is described.

In FIG. 1, reference numeral 1 represents an image forming apparatus that in the present embodiment is a tandem-type multicolor copier, 3 represents a document feeder to send a document to a document reading unit 4 that reads image data of the document, 5 represents an output tray on which output images are stacked, 7 represents a sheet feeding tray containing sheets P of recording media, 8 represents sheet feeding rollers, 9 represents a registration roller pair to adjust the timing to transport the sheet P, 11 (11Y, 11M, 11C, and 11BK) represents photoconductor drums serving as image bearers on which yellow, magenta, cyan, and black toner images are formed, respectively, 13 represents developing devices to develop electrostatic latent images formed on the respective photoconductor drums 11, and 14 represents primary-transfer bias rollers to transfer toner images from the respective photoconductor drums 11 onto an intermediate transfer belt 17 serving as an intermediate transfer member. On the intermediate transfer belt 17, multiple different color toners are superimposed. The intermediate transfer member is not limited to a belt but can be an intermediate transfer drum.

Additionally, reference numeral 18 represents a secondary-transfer bias roller to transfer the superimposed toner image from the intermediate transfer belt 17 onto the sheet P, 20 represents a fixing device to fix the toner image on the sheet P, and 28 represents toner containers from which respective color toners are supplied to developing devices 13. Reference numeral 50 represents an image density detector to detect the image density of a toner image formed, for detection, on the intermediate transfer belt 17.

Operations of the image forming apparatus 1 illustrated in FIG. 1 to form multicolor images are described below. It is to be noted that FIG. 2 is also referred to when image forming process performed on the respective photoconductor drums 11 (11Y, 11M, 11C, and 11BK) are described.

Conveyance rollers disposed in the document feeder 3 transport documents set on a document table onto an exposure glass (contact glass) of the document reading unit 4. Then, the document reading unit 4 reads image data of the document set on the exposure glass optically.

More specifically, the document reading unit 4 scans the image of the document on the exposure glass with light emitted from an illumination lamp. The light reflected from the surface of the document is imaged on a color sensor via mirrors and lenses. The multicolor image data of the document is decomposed into red, green, and blue (RGB), read by the color sensor, and converted into electrical image signals. Further, an image processor performs image processing (e.g., color conversion, color calibration, and spatial frequency adjustment) according to the image signals, and thus image data of yellow, magenta, cyan, and black are obtained.

Figure 2:
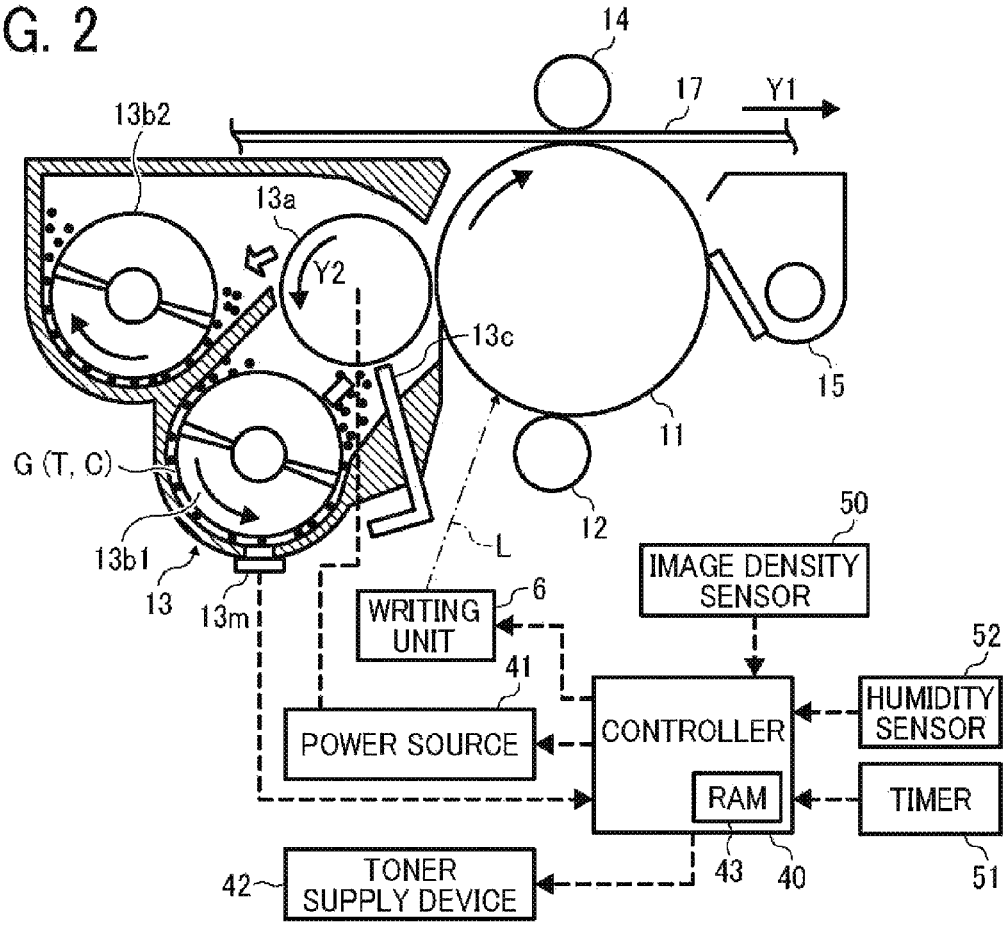
FIG. 2 is a schematic diagram illustrating a configuration of an image forming station included in the image forming apparatus illustrated in FIG. 1.

Then, the yellow, magenta, cyan, and black image data is transmitted to the writing unit 6 (i.e., an exposure device, illustrated in FIG. 2). The writing unit 6 directs laser beams L (illustrated in FIG. 2) to surfaces of the respective photoconductors 11 according to the image data of the respective colors.

Meanwhile, the four photoconductor drums 11 rotate clockwise in FIG. 1. As illustrated in FIG. 2, the surface of each photoconductor drum 11 is charged by a charging device 12 (e.g., a charging roller) uniformly at a position facing the charging device 12 (charging process). Thus, the surface of the photoconductor drum 11 has a predetermined electrical potential. Subsequently, the charged surface of the photoconductor drum 11 reaches a position to receive the laser beam L.

The writing unit 6 emits the laser beams L according to the image data from four light sources. The four laser beams L pass through different optical paths for yellow, magenta, cyan, and black.

The laser beam L corresponding to the yellow component is directed to the photoconductor drum 11Y that is the first from the left in FIG. 1 among the four photoconductor drums 11. A polygon mirror that rotates at high velocity deflects the laser beam L for yellow in a direction of a rotation axis of the photoconductor drum 11Y (main scanning direction) so that the laser beam L scans the surface of the photoconductor drum 11Y. Thus, an electrostatic latent image for yellow is formed on the photoconductor drum 11 charged by the charging device 12.

Similarly, the laser beam L corresponding to the magenta component is directed to the surface of the photoconductor drum 11M that is the second from the left in FIG. 1, thus forming an electrostatic latent image for magenta thereon. The laser beam L corresponding to the cyan component is directed to the surface of the photoconductor drum 11C that is the third from the left in FIG. 1, thus forming an electrostatic latent image for cyan thereon. The laser beam L corresponding to the black component is directed to the surface of the photoconductor drum 11BK that is the fourth from the left in FIG. 1, thus forming an electrostatic latent image for black thereon.

Subsequently, the surface of each photoconductor drum 11 where the electrostatic latent image is formed is further transported to the position (i.e., a developing range) facing the developing device 13. The developing devices 13 supply toners of the corresponding colors to the photoconductor drums 11, respectively, to develop the latent images on the photoconductor drums 11 into different single-color toner images (development process).

Subsequently, the surfaces of the photoconductor drums 11 reach positions facing the intermediate transfer belt 17. The primary-transfer bias rollers 14 are disposed at the positions where the respective photoconductor drums 11 face the intermediate transfer belt 17 and in contact with an inner surface of the intermediate transfer belt 17. At these positions, the toner images on the respective photoconductor drums 11 are sequentially transferred and superimposed one on another, into a multicolor toner image, on the intermediate transfer belt 17 at the positions facing the primary-transfer bias rollers 14 (primary transfer nips), which is a primary transfer process.

Subsequently, the surface of each photoconductor drum 11 reaches a position facing the cleaning device 15, where toner remaining on the photoconductor drum 11 (hereinafter "untransferred toner") is collected (cleaning process).

Additionally, the surface of each photoconductor drum 11 passes through a discharge device. Thus, a sequence of image forming processes performed on each photoconductor drum 11 is completed.

Meanwhile, while moving counterclockwise in the drawing, the surface of the intermediate transfer belt 17 carrying the superimposed toner image passes by a position detected by the image density detector 50 and then reaches a position facing the secondary-transfer bias roller 18. The secondary-transfer bias roller 18 transfers the multicolor toner image from the intermediate transfer belt 17 onto the sheet P (secondary transfer process).

Further, the surface of the intermediate transfer belt 17 reaches a position facing a belt cleaning device. The belt cleaning device collects untransferred toner remaining on the intermediate transfer belt 17, and thus a sequence of transfer processes performed on the intermediate transfer belt 17 is completed.

The sheet P is transported from one of the sheet feeding trays 7 via the registration roller pair 9, and the like, to the secondary transfer nip between the intermediate transfer belt 17 and the secondary-transfer bias roller 18.

More specifically, the sheet feeding roller 8 sends out the sheet P from the sheet feeding tray 7, and the sheet P is then guided by a sheet guide to the registration roller pair 9. The registration roller pair 9 forwards the sheet P to the secondary transfer nip, timed to coincide with the arrival of the multicolor toner image on the intermediate transfer belt 17.

Then, the sheet P carrying the multicolor image is transported to the fixing device 20. The fixing device 20 includes a fixing roller and a pressure roller pressing against each other. In a nip therebetween, the multicolor image is fixed on the sheet P.

After the fixing process, a pair of ejection rollers discharges the sheet P as an output image to the output tray 5, disposed outside the image forming apparatus 1. Thus, a sequence of image forming processes (image forming operation) is completed.

Next, image forming stations are described in further detail below, with reference to FIG. 2.

It is to be noted that the subscripts Y, C, M, and BK are omitted in the drawings for simplicity because the image forming stations have a similar configuration.

As illustrated in FIG. 2, each image forming station includes the photoconductor drum 11, the charging device 12, the developing device 13, the cleaning device 15, and the like. It is to be noted that, in the present embodiment, the writing unit 6 and the image forming station including the developing device 13 together serve as an image forming device to form an image on the image bearer (i.e., the photoconductor drum 11). Alternatively, the image bearer includes a latent image bearer (i.e., the photoconductor drum 11) and the intermediate transfer member, and the writing unit 6, the image forming station including the developing device 13, and the primary-transfer bias roller 14 together serve as an image forming device to form an image on the image bearer (i.e., the intermediate transfer belt 17).

The photoconductor drum 11 in the present embodiment is a negatively-charged organic photoconductor having an external diameter of about 30 mm and is rotated counterclockwise in FIG. 2 by a driving unit.

The charging device 12 is an elastic charging roller and can be formed by covering a metal core with an elastic layer of moderate resistivity, such as foamed urethane layer, that includes carbon black as conductive particles, sulfuration agent, foaming agent, and the like. The material of the elastic layer of moderate resistivity include, but not limited to, rubber such as urethane, ethylene-propylene-diene-polyethylene (EPDM), acrylonitrile butadiene rubber (NBR), silicone rubber, and isoprene rubber to which conductive material such as carbon black or metal oxide is added to adjust the resistivity. Alternatively, foamed rubber including these materials may be used.

The cleaning device 15 includes a cleaning brush or a cleaning blade that slidingly contacts the surface of the photoconductor drum 11 and removes toner adhering to the photoconductor drum 11 mechanically.

The developing device 13 includes a developing roller 13*a*, serving as a developer bearer, disposed across a gap of predetermined size from the photoconductor drum 11. In the portion where the developing roller 13*a* faces the photoconductor drum 11, the developing range where a magnetic brush contacts the surface of the photoconductor drum 11 is generated. The developing device 13 contains two-component developer G including toner T (toner particles) and carrier C (carrier particles). In the present embodiment, the developing device 13 contains the developer G in which the concentration of toner T is from about 5 to about 9 percent by weight, for example. The developing device 13 develops the latent image on the photoconductor drum 11 into a toner image. Sine a casing (housing) of the developing device 13 includes an opening to expose the developing roller 13*a* to the photoconductor drum 11, an interior of the casing is not highly sealed. The configuration and operation of the developing device 13 are described in further detail later.

Referring to FIGS. 1 and 2, the toner container 28 contains the toner T to be supplied to the developing device 13. Specifically, the developing device 13 includes a magnetic sensor 13*m* serving as a toner concentration detector. According to the toner concentration (the ratio of toner in developer G) detected by the magnetic sensor 13*m*, the toner supply device 42 supplies the toner T from the toner container 28 to the interior of the developing device 13.

For example, the toner supply device 42 to supply the toner T to the developing device 13 has the following structure. A flexible tube connects the toner container 28 (or a hopper to store the toner discharged from the toner container 28) with the developing device 13, and a powder pump is disposed in the tube to move the toner inside the tube, thereby transporting the toner together with air. Sealing of the toner supply device 42 is enhanced to prevent leak of toner.

The magnetic sensor 13*m* (toner concentration detector) detects the magnetic permeability of developer G, thereby detecting the concentration of toner in the developer.

The developing device 13 is described in further detail below.

Referring to FIG. 2, the developing device 13 includes the developing roller 13*a* serving as the developer bearer, first and second conveying screws 13*b*1 and 13*b*2 serving as first and second developer conveyors, and a doctor blade 13*c* serving as a developer regulator.

The outer diameter of the developing roller 13*a* is relatively small and about 18 mm, for example. The developing roller 13*a* includes a sleeve, which is a nonmagnetic cylindrical member made of aluminum, brass, stainless steel, conductive resin, or the like and is configured to rotate counterclockwise in FIG. 2, driven by a driving unit. Inside the sleeve of the developing roller 13*a*, a magnet is disposed to generate multiple magnetic poles around the circumference of the sleeve. The magnet is stationary in contrast to the sleeve. The developer G carried on the developing roller 13*a* is transported in the direction indicated by arrow Y2 in FIG. 2 to the doctor blade 13*c*. The amount of the developer G on the developing roller 13*a* is adjusted to a suitable amount by the doctor blade 13*c*, after which the developer G is carried to the developing range facing the photoconductor drum 11. Then, the toner is attracted to the latent image on the photoconductor drum 11 by the electrical field (developing potential) generated in the developing range.

It is to be noted that, in FIG. 2, reference numerals 51 represents a timer disposed inside the image forming apparatus 1, and 52 represents a humidity sensor. The timer 51 and the humidity sensor 52 are electrically coupled to the controller 40.

In the present embodiment, a power source 41 (i.e., a developing voltage application device) applies a predetermined voltage, as a developing bias, to the developing roller 13*a*. The difference between the developing bias applied to the developing roller 13*a* and the latent image potential generated on the surface of the photoconductor drum 11 becomes the developing potential. The latent image potential is generated on the surface of the photoconductor drum 11 with exposure by the writing unit 6. The developing potential causes the toner T in the developer G to electrostatically move from the developing roller 13*a* to the latent image on the photoconductor drum 11 to form a toner image.

Referring to FIG. 2, the doctor blade 13*c* is a nonmagnetic planer component disposed below the developing roller 13*a*. The doctor blade 13*c* can include a magnetic portion. In FIG. 2, the developing roller 13*a* rotates counterclockwise, and the photoconductor drum 11 rotates clockwise.

The first conveying screw 13*b*1 and the second conveying screw 13*b*2 agitate and mix the developer G contained in the developing device 13 while transporting the developer G horizontally in the longitudinal direction or the axial direction, perpendicular to the surface of the paper on which FIG. 2 is drawn.

The first conveying screw 13*b*1 is disposed facing the developing roller 13*a* and supplies the developer G to the developing roller 13*a* at the position corresponding to an developer scooping pole while transporting the developer G horizontally from a first end to a second end in the longitudinal direction of the developing device 13. The first conveying screw 13*b*1 rotates counterclockwise in FIG. 2.

The second conveying screw 13*b*2 is disposed above the first conveying screw 13*b*1 and faces the developing roller 13*a*. The conveying screw 13*b*2 transports developer G that has left the developing roller 13*a* (developer that is forced to leave the developing roller 13*a* after the developing process) horizontally from the second end to the first end. It is to be noted that, in the present embodiment, the second conveying screw 13*b*2 is configured to rotate clockwise in FIG. 2, which is opposite the direction of rotation of the developing roller 13*a*.

From the downstream side of a first conveyance compartment, in which the first conveying screw 13*b*1 is disposed, the developer flows through a first communication opening to a second conveyance compartment, in which the second conveying screw 13*b*2 is disposed. The second conveying screw 13*b*2 transports the flowing-in developer to the upstream side of the first conveyance compartment through a second communication opening.

An inner wall of the developing device 13 separates the first conveyance compartment in which the first conveying screw 13*b*1 is disposed from the second conveyance compartment in which the second conveying screw 13*b*2 is disposed.

Although not illustrated, the downstream side of the second conveyance compartment communicates with the upstream side of the first conveyance compartment through the second communication opening. On the downstream side of the second conveyance compartment, the developer G falls under its own weight through the second communication opening to the upstream side of the first conveyance compartment.

The downstream side of the first conveyance compartment communicates with the upstream side of the second conveyance compartment through the first communication opening. In the first conveyance compartment, the developer G that is not supplied to the developing roller 13*a* accumulates adjacent to the first communication opening and then flows through the first communication opening to the upstream side of the second conveyance compartment.

It is to be noted that the magnetic sensor 13*m* to detect the toner concentration in the developer G circulated in the developing device 13 is disposed in or outside the first conveyance compartment. Based on the toner concentration detected by the magnetic sensor 13*m*, the toner T (supplied toner) is supplied from the toner container 28 to the developing device 13 through the toner supply inlet, which is disposed adjacent to the first communication opening.

Next, the developer G usable in the present embodiment is described below.

The toner T (a component of developer G) used in the present embodiment is polymerization toner and includes binder resin. Examples of the binder resin include styrene resin (single polymer or copolymer that includes styrene or styrene substitution product) such as styrene-acrylonitrile-acrylate copolymer, polyester resin, epoxy resin, and compounds thereof. Such polymerization toners can be produced using bulk polymerization, solution polymerization, emulsion polymerization, or suspension polymerization.

As an external additive, inorganic fine particles are preferable. For example, 1.0 weight percent of silica and 0.5 weight percent of titanium oxide may be used. As a release agent, oxide of rice wax, low-molecular polypropylene wax, or carnauba wax may be used. Additionally, a charge controlling agent may be included.

The toner T used in the present embodiment is small-diameter toner having a volume average particle diameter of about 6 μm. In the toner T, percentage by number of particles having a diameter of 5 μm or smaller is about 60% to about 80%. The toner T used in the present embodiment is configured to be charged in the negative polarity.

It is to be noted that pulverized toner can be used instead of polymerization toner.

The carrier C in the developer G used in the present embodiment is small-diameter carrier having a weight average particle diameter ranging from about 20 μm to about 60 μm. For example, weight average particle diameter of carrier C is about 35 μm in the present embodiment.

Specifically, the carrier C includes a ferrite particle as a core and, and the core particle is coated with 0.5 μm of methylmethacrylate (MMA) resin having a film thickness of about 0.5 μm to have the above-described particle diameter, for example. Alternatively, coated carrier having a magnetite core may be used.

Use of small-diameter carrier can enhance density uniformity of solid images or halftone image quality. Additionally, small-diameter carrier can enhance toner coverage over carrier and is good with small-diameter toner suitable for high image quality.

The toner concentration in the developer G contained in the developing device 13 is controlled within a range from about 5% to about 9% by weight for each color according to standardized charge level of developer G. The charge amount per mass (Q/M) of developer decreases as the toner concentration increases and increases as the toner concentration decreases. The above-mentioned standardized charge level means the charge amount (Q/M) under a condition of constant toner concentration (for example, 7% by weight).

When the standardized charge level is high, the toner concentration is increased (to about 8.5% by weight, for example) to attain a desired image density. When the standardized charge level is low, the toner concentration is reduced (to about 5.5% by weight, for example). It is to be noted that the standardized charge level of developer is not adjustable but is determined by the environment, the usage amount of developer (i.e., the number of sheets printed after the start of use of fresh developer), and history of print coverage. Generally, the standardized charge level tends to be high when the humidity is low or the print coverage ratio is small and tends to be low when the humidity is high or the print coverage ratio is high. That is, the control level of the toner concentration is correlated with the standardized charge level and determined by the environment, the usage amount of developer (i.e., the number of sheets printed after the start of use of fresh developer), and history of print coverage.

Next, a control operation of the image forming apparatus 1, which is a characteristic feature of the present embodiment, is described below.

As described above, the image forming apparatus 1 according to the present embodiment includes the photoconductor drum 11 serving as the image bearer, the developing device 13 including the developing roller 13*a* (the developer bearer), the magnetic sensor 13*m* serving as the toner concentration detector, and the toner supply device 42 to supply toner to the developing device 13.

The image forming apparatus 1 further includes the image density detector 50 to optically detect the image density of the toner image formed, for detection, on the intermediate transfer belt 17, to which the toner image is transferred from the photoconductor drum 11.

Figure 3:
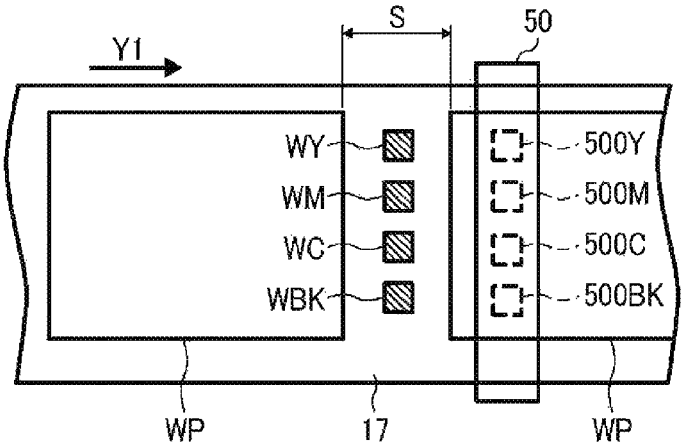
FIG. 3 is a schematic plan view of a detection toner image, formed on a non-image area on a surface of an intermediate transfer belt, according to an embodiment.

Specifically, the image density detector 50 is disposed facing the surface (i.e., outer side or front side) of the intermediate transfer belt 17 and positioned downstream from the photoconductor drums 11 (11Y, 11M, 11C, and 11BK) and upstream from the secondary-transfer bias roller 18 in the direction of rotation of the intermediate transfer belt 17 indicated by arrow Y1 in FIGS. 2 and 3. Referring to FIG. 3, in the present embodiment, the image density detector 50 includes reflective photosensors 500Y, 500M, 500C, and 500BK ranged in a width direction of the intermediate transfer belt 17 (in a direction perpendicular to the surface of the paper on which FIG. 1 is drawn and vertical in FIG. 3). Each of the reflective photosensors 500Y, 500M, 500C, and 500BK is configured to output a signal (voltage) corresponding to the reflectance of light on the surface of the intermediate transfer belt 17. Each of the reflective photosensors 500Y, 500M, 500C, and 500BK is configured to detect either diffuse reflection of light or specular reflection of light. Referring to FIG. 3, separately from standard toner images WP to be transferred onto the sheets P, detection toner images WY, WM, WC, and WBK (hereinafter also collectively "detection toner images W) are formed, as a patch pattern, on the intermediate transfer belt 17 in a manner similar to the above-described image forming process. The reflective photosensors 500Y, 500M, 500C, and 500BK are configured to detect changes in the level of light reflected on the detection toner images WY, WM, WC, and WBK. In the present embodiment, the detection toner images WY, WM, WC, and WBK are primarily transferred from the photoconductor drums 11Y, 11M, 11C, and 11BK onto the intermediate transfer belt 17 to line up in the width direction to match the positions of the reflective photosensors 500Y, 500M, 500C, and 500BK. In standard image formation, to prevent the detection toner images WY, WM, WC, and WBK from being transferred onto the sheet P (from affecting the standard image formation), the detection toner images WY, WM, WC, and WBK are formed in a non-image area S (i.e., a sheet interval area), which corresponds to a sheet interval (between a preceding toner image WP and a subsequent toner image WP to be transferred onto the sheet P).

In the image forming apparatus 1 according to the present embodiment, before standard image formation (i.e., printing operation) is started, the detection toner images W (WY, WM, WC, and WBK) are formed on the surface of the intermediate transfer belt 17 at a predetermined timing, such as, after a main power is powered on and after recovery from a standby mode. Then, a controller 40 of the image forming apparatus 1 adjusts, for each color, the developing potential (the difference between the developing bias applied to the developing roller 13*a* and the latent image potential on the photoconductor drum 11) to keep the image density of each detection toner image W (WY, WM, WC, and WBK) detected by the image density detector 50 at a target value Y. Additionally, the controller 40 drives the toner supply device 42 or the developing device 13 to keep the toner concentration detected by the magnetic sensor 13*m* (i.e., the toner concentration detector) at a target value X0. For example, the controller 40 instructs supply of toner to the developing device 13 or discharge of toner from the developing device 13. In other words, before the standard image formation is started, so-called process control is executed at the predetermined timing to adjust the developing potential, the toner concentration, and the like.

After the standard image formation (printing operation) is started, the toner supply device 42 is driven to keep the toner concentration detected by the magnetic sensor 13*m* at the target value X0. In other words, after the standard image formation is started, the magnetic sensor 13*m* detects the consumption of toner in the developing device 13, and the controller 40 drives the toner supply device 42 to supply an amount of toner equivalent to the consumption to make the toner concentration close to the target value X0.

Additionally, at a predetermined timing (for example, each time accumulative printing number of sheets reaches ten) after the start of standard image formation (printing operation), the image density detector 50 detects the image density of each detection toner image W on the intermediate transfer belt 17. Based on the detection results generated by the image density detector 50, the controller 40 adjusts the target value X0 and controls the toner concentration based on an adjusted target value X0'. That is, after the standard image formation (printing operation) is started, the controller 40 controls the toner concentration while adjusting the target value X0 based on the image density of each the detection toner image W detected by the image density detector 50.

With such control operation, preferable image quality is attained with stable image density.

More specifically, before the printing operation is started, the controller 40 executes the process control at the predetermined timing, such as, turning on of the main power of the image forming apparatus 1, in the standby mode entering after a predetermined period has passed, and in the standby mode entering after completion of printing of a predetermined number of sheets or greater. In the process control, the image density is adjusted.

At the timing to execute the process control (i.e., a process control timing), initially, the image density detector 50 is calibrated. In this calibration, the image density detector 50 is activated in a state in which no toner image is present on the intermediate transfer belt 17. While the image density detector 50 is activated, a light emission intensity of the image density detector 50 is changed sequentially to find a light emission intensity at which the detected voltage (signal generated by the image density detector 50) coincides with a predetermined voltage value. Then, the light emission intensity is stored in a memory device, such as a random access memory (RAM) 43 of the controller 40 and used in subsequent adjustment of the image density.

Subsequently, while the photoconductor drums 11 rotates, the surfaces thereof are charged. In the charging process at that time, differently from the charging bias (about −700 V) applied in the printing operation, the controller 40 progressively increases the charging bias. Then, governed by the controller 40, the writing unit 6 performs the exposure process to form an electrostatic latent image of the detection toner image W, which is a gradation pattern including multiple toner patches different in density, on each of the photoconductor drums 11. The developing device 13 develops the electrostatic latent image of the gradation pattern. In the developing process, the gradation patterns for yellow, magenta, cyan, and black (detection toner images WY, WM, WC, and WBK) are formed on the photoconductor drums 11Y, 11M, 11C, and 11BK, respectively.

It is to be noted that, in the developing process, the controller 40 progressively changes (increases or decreases) the developing bias applied to the developing roller 13*a* of each of the developing devices 13.

Subsequently, the gradation patterns (the detection toner images WY, WM, WC, and WBK) are transferred onto the intermediate transfer belt 17. When the gradation patterns pass by the position facing the image density detector 50 as the intermediate transfer belt 17 rotates, the image density detector 50 detects the amount of light reflected by the gradation patterns. Then, the image density detector 50 outputs the electrical signal (i.e., voltage) corresponding to each patch constituting the gradation pattern of each color. Based on the signals sequentially output from the image density detector 50, the controller 40 calculates the amount of toner adhering to each of the multiple toner patches (about 10 toner patches in the present embodiment) of each color gradation pattern. The controller 40 stores the calculated amount of toner adhering in the RAM 43. When the controller 40 stores the amount of toner adhering in the RAM 43, the controller 40 estimates the developing potential based on the image forming conditions for respective color gradation patterns. The controller 40 stores data relating to the gradation patterns in the RAM 43.

The gradation patterns (the detection toner images WY, WM, WC, and WBK) on the intermediate transfer belt 17 include the multiple toner patches arranged in the direction of rotation of the intermediate transfer belt 17. As the intermediate transfer belt 17 rotates, the gradation patterns reach the belt cleaner and are removed by the belt cleaner.

Figure 4A:
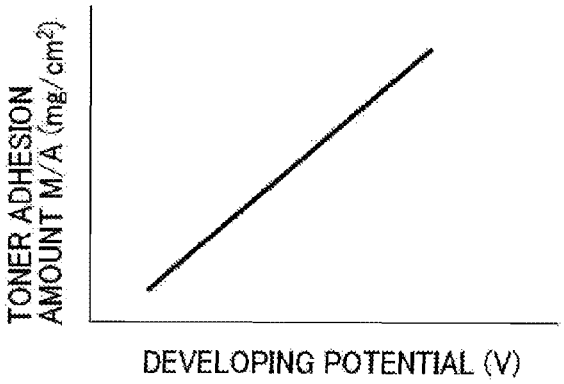
FIG. 4A is a graph illustrating a relation between a developing potential and a toner adhesion amount.

FIG. 4A is a graph illustrating the relation between the developing potential in formation of the detection toner image W and the toner adhesion amount M/A of the detection toner image W. The toner adhesion amount M/A means the amount of toner adhering to a unit area of the toner image on the intermediate transfer belt 17 or the photoconductor drum 11. The controller 40 selects, from multiple data values plotted, a linear section such as that illustrated in FIG. 4A and applies a least squares method to the data values in the selected section to obtain linear equations by approximation. Then, the controller 40 calculates the linear equation for each color. With the linear equations, the controller 40 calculates the developing potential to attain the target toner adhesion amount (i.e., the target value Y) and adjusts the image forming conditions (laser diode power of the writing unit 6, the charging bias, the developing bias, and the like) to adjust the toner adhesion amount (image density) to the target value Y (i.e., a predetermined value). That is, in a broad sense, the term "adjustment (or readjustment) of developing potential" used in the present disclosure means adjustment (or readjustment) of the image forming conditions.

As described above, the process control is performed to change the developing potential, thereby adjusting the image density at the target value Y, at the predetermined timing. In the printing operation until the subsequent process control is executed, the detection toner images W are formed in the non-image area S (sheet interval area) regularly (for example, each time the number of printed sheets reaches ten), and the image density detector 50 detects the amount of light reflected by the gradation patterns. Then, a computation part of the controller 40 converts the amount of light reflected to the toner adhesion amount, and the controller 40 compares the toner adhesion amount with the target toner adhesion amount (target value Y). When the toner adhesion amount (image density) of each detection toner image W is lower than the target value Y, the controller 40 adjusts a control reference value Vtref, which is a voltage value output from the magnetic sensor 13*m* and correlated to the target value X0 of the toner concentration. The controller 40 changes the control reference value Vtref in the direction to raise the toner concentration. By contrast, when the toner adhesion amount (image density) of the detection toner image W is higher than the target value Y, the controller 40 adjusts the control reference value Vtref in the direction to lower the toner concentration. As the toner concentration rises, a mean charge amount of toner per unit toner mass (Q/M) in the two-component developer decreases, and the developing capability increases. Accordingly, the toner adhesion amount (image density) of the detection toner image W (WY, WM, WC, and WBK) increases and recovers to the target value Y. By contrast, as the toner concentration lowers, the mean charge amount Q/M of toner in the two-component developer increases, and the developing capability decreases. Accordingly, the toner adhesion amount (image density) of the detection toner image W decreases and recovers to the target value Y. With such control operation, the image density of the toner image is kept constant.

In the present embodiment, after the standard image formation is started, the controller 40 executes the above-described control operation, in which the toner concentration is controlled while the target value X0 is corrected. Further, the following operation is performed.

In the present embodiment, after the standard printing operation is started, when the toner concentration (TC) detected by the magnetic sensor 13*m* is higher than the target value X0 by a threshold α (difference) or greater (X0+α or greater), the printing operation is suspended. Then, the detection toner images W are formed on the intermediate transfer belt 17, and the controller 40 readjusts the developing potential so that the image density of each detection toner image W detected by the image density detector 50 is kept at the target value Y. In other words, after the printing operation is started, while performing the toner concentration control in which the target value X0 is corrected as required, when the toner concentration is greater than the target value X0 by the threshold α (X0+α) or greater, printing is suspended to readjust the developing potential (in a manner similar to the control operation performed before the printing is started.

Such control operation is advantageous to inhibit the following inconveniences, for example. Even if the developing potential and the toner concentration are adjusted before image formation is started, there is a risk that the toner concentration can abruptly rise in subsequent printing operation. Such abrupt rise of toner concentration tends to occur when the image forming apparatus 1 is left unused in a humid environment for a long time (i.e., image formation interval). The abrupt rise in toner concentration can result in background fog on the surface of the photoconductor drum 11 (image bearer) and unstable image density. Such inconveniences are inhibited by the control operation according to the present embodiment.

Such effects are described in further detail below.

Since the sealing of the developing device 13 is relatively low, the air inside the developing device 13 has a humidity similar to the humidity of the environment in which the image forming apparatus 1 is installed (i.e., ambient humidity). Accordingly, in the case where the image forming apparatus 1 is heft unused for a long time in a humid environment, it is possible that the toner T in the two-component developer G contained in the developing device 13 absorbs moisture and a chargeability TA of the toner T decreases. The term "chargeability TA" used here means the mean charge amount (Q/M) in a state in which the two-component developer G has been stirred in the developing device 13 and fully charged. The chargeability TA of the toner T in the two-component developer G in the developing device 13 of the apparatus that has been left unused in a humid environment for a long time is hereinafter referred to as "chargeability TA1".

By contrast, the sealing of the toner supply device 42 (including the toner container 28) is relatively high. That is, the toner T inside the toner supply device 42 is under a humidity different from the humidity of the ambient environment around the image forming apparatus 1. Accordingly, even if the image forming apparatus 1 is heft unused for a long time in a humid environment, the humidity inside the toner supply device 42 is kept at a relatively low humidity. Thus, in the toner supply device 42, the toner T is less likely to absorb moisture, and the chargeability TA of the toner T does not decrease. When a chargeability TA2 represent the chargeability of the toner T in the toner supply device 42 (and the toner container 28) after the apparatus is left unused in a humid environment for a long time, a relation TA1<TA2 is established.

Figure 4B:
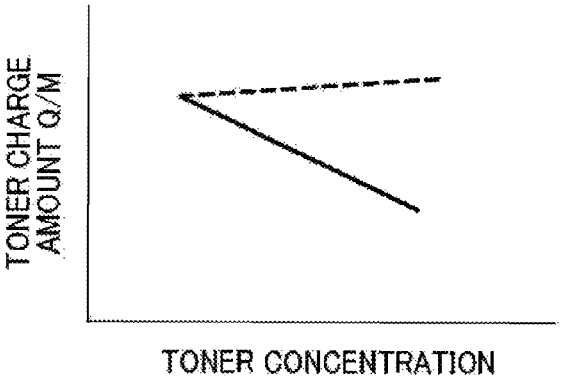
FIG. 4B is a graph illustrating a relation between a toner concentration and a toner charge amount.

FIG. 4A is graph of changes in the mean charge amount (Q/M) of toner when the toner is supplied to the developing device 13 in a case where the image density of the detection toner image W (WY, WM, WC, or WBK) is lower than the target value Y. In a case where the chargeability TA1 of the toner kept in the developing device 13 is equivalent to the chargeability TA2 of the toner supplied to the developing device 13 (TA1=TA2), as indicated by a solid line in FIG. 4B, as the toner is supplied, the toner charge amount Q/M decreases below the toner charge amount Q/M of the developer to which the toner is not yet supplied. As described above, however, after the image forming apparatus 1 is left unused in a humid environment for a long time, the chargeability TA1 of the toner kept in the developing device 13 is lower than the chargeability TA2 of the toner supplied to the developing device 13. Then, the toner concentration TC increases as the toner is supplied to the developing device 13. Accordingly, in the printing operation after the image formation interval, toners different in chargeability (the chargeability TA1 and the chargeability TA2) are mixed in the developing device 13. Therefore, as indicated by broken lines in FIG. 4B, the toner charge amount Q/M in the two-component developer G in the developing device 13 becomes higher than that before the toner supply.

While the toner concentration TC is increased by the toner supply, if the toner charge amount Q/M increases as well, the decreased image density of the detection toner image W does not increase nor recover to the target value Y even if the toner is repeatedly supplied. In the control operation, there is a risk that the toner is excessively supplied to the developing device 13 in a relatively short period, and the toner concentration TC therein increases abruptly, which can cause the following inconveniences. The amount of toner exceeds the capacity of the developing device 13 to stir the supplied toner to charge the supplied toner. Then, insufficiently charged toner remains on the surface of the photoconductor drum 11 as background fog. The toner concentration reaches an upper limit of a preferable range, and subsequent toner concentration adjustment becomes unfeasible. Then, the image density is not kept constant.

As aspect of the present embodiment is to inhibit inconveniences caused by such abrupt rise of the toner concentration TC.

Figure 5:
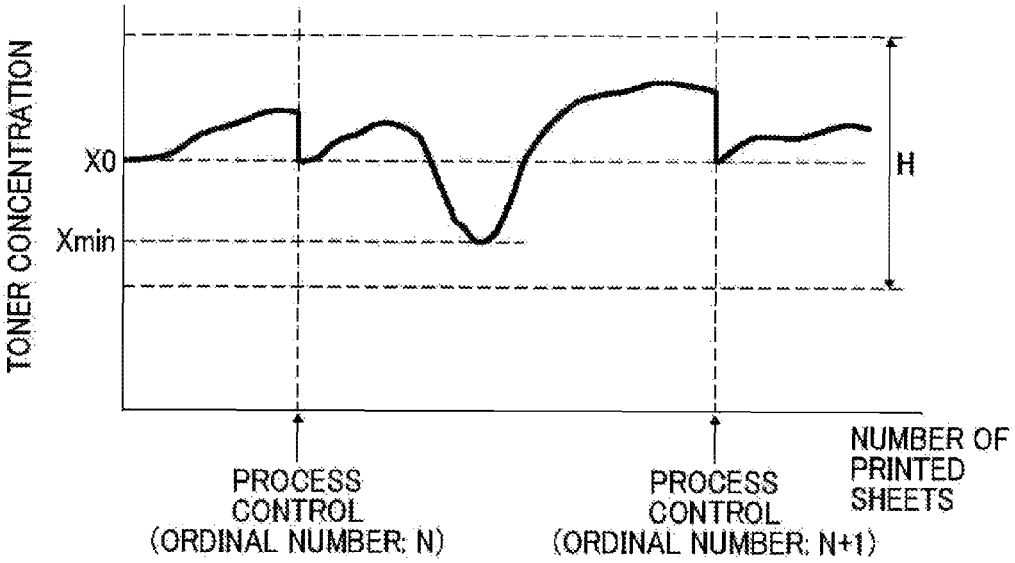
FIG. 5 is a graph of example changes in the toner concentration with time.

In the present embodiment, during the printing operation, the magnetic sensor 13*m* constantly detects the toner concentration TC in the developer G contained in the developing device 13. FIG. 5 is a graph of example changes in the toner concentration detected by the magnetic sensor 13*m*. As illustrated in FIG. 5, while the accumulative number of sheets printed increases, the process control is performed at the predetermined timings as described above. In addition to immediately after power on of the main power and completion of standby mode, the process control is preliminarily settable to occur after a constant number of sheets are printed, the environment inside the apparatus (i.e., temperature, humidity, or both) changes for a predetermined amount or greater, and the like.

In FIG. 5, a reference character "H" represents a usable range of the toner concentration TC, which in the present embodiment is from about 5% to 9% by weight.

Additionally, in the present embodiment, at the timing to execute the process control, the toner concentration TC is adjusted to the target value X0. The target value X0 is different from the boundary values of the range H by an adjustment amount to keep the image density of the detection toner image W (WY, WM, WC, and WBK) at the target value Y by adjusting the toner concentration TC in the subsequent printing operation.

More specifically, to adjust the toner concentration TC, the toner supply device 42 is driven to supply toner to the developing device 13. Alternatively, a toner pattern for consuming toner is formed via the developing device 13 on the intermediate transfer belt 17, and the toner pattern is not transferred to the sheet P but is collected by the belt cleaner. It is to be noted that, although the target value X0 of the toner concentration TC is at about a center of the range H in FIG. 5, the target value X0 is not limited thereto but can be set to any value with which the adjustment amount for the toner concentration TC is maintained.

In the present embodiment, during the printing operation between the previous process control (with the ordinal number N in FIG. 5) and the subsequent process control (with the ordinal number N+1 in FIG. 5), the controller 40 compares the target value X0 of the toner concentration TC adjusted in the previous process control (ordinal number N) with a current value of the toner concentration TC constantly detected by the magnetic sensor 13*m*. If the target value X0 is corrected during the printing, the corrected target value X0 is compared with the detected toner concentration TC. When the current value of the toner concentration TC is higher than the target value X0 plus the threshold $\alpha$ (difference) or greater, the printing is suspended to again perform the process control, thereby readjusting the developing potential to keep the image density to the target value Y.

In the present embodiment, the above-described threshold $\alpha$ is set to about 1.5% to 2% by weight. The usable range of the toner concentration TC is from about 5% to 9% by weight, the entire range of which is used in a case where the standardized charge level of developer changes depending on the environment or the usage amount (represented by the number of sheet printed after the developer is replaced). In a case where the subsequent process control is performed in a relatively short period, the environment is not likely to change to a degree requiring such a wide range of toner concentration till the subsequent process control. Unless the apparatus is left unused in the humid environment for a long time as described above, about 1.5% to 2% by weight is sufficient as the extent of fluctuation to keep the image density constant in printing.

Thus, in the present embodiment, in the printing operation after the image forming apparatus 1 is left unused in the humid environment for a long time, the magnetic sensor 13*m* can detect a state that can result in abrupt rise of the toner concentration TC before the toner concentration TC rises abruptly in a short period. As described above, the abrupt rise can occur when the toner charge amount Q/M increases as the toner concentration TC is increased by the toner supply, and the decreased image density of the detection toner image W does not increase nor recover to the target value Y. Recognizing such as state, the controller 40 readjusts the developing potential. Therefore, the control operation according to the present embodiment can inhibit the abrupt rise of the toner concentration TC and background fog or unstable image density caused thereby.

It is to be noted that, although the abrupt rise of the toner concentration TC is inhibited better when the threshold $\alpha$ is small, the frequency of interruption of printing to execute the process control increases, thus reducing the productivity of printing. Therefore, it is preferred that the threshold $\alpha$ be not too small.

Figure 6:
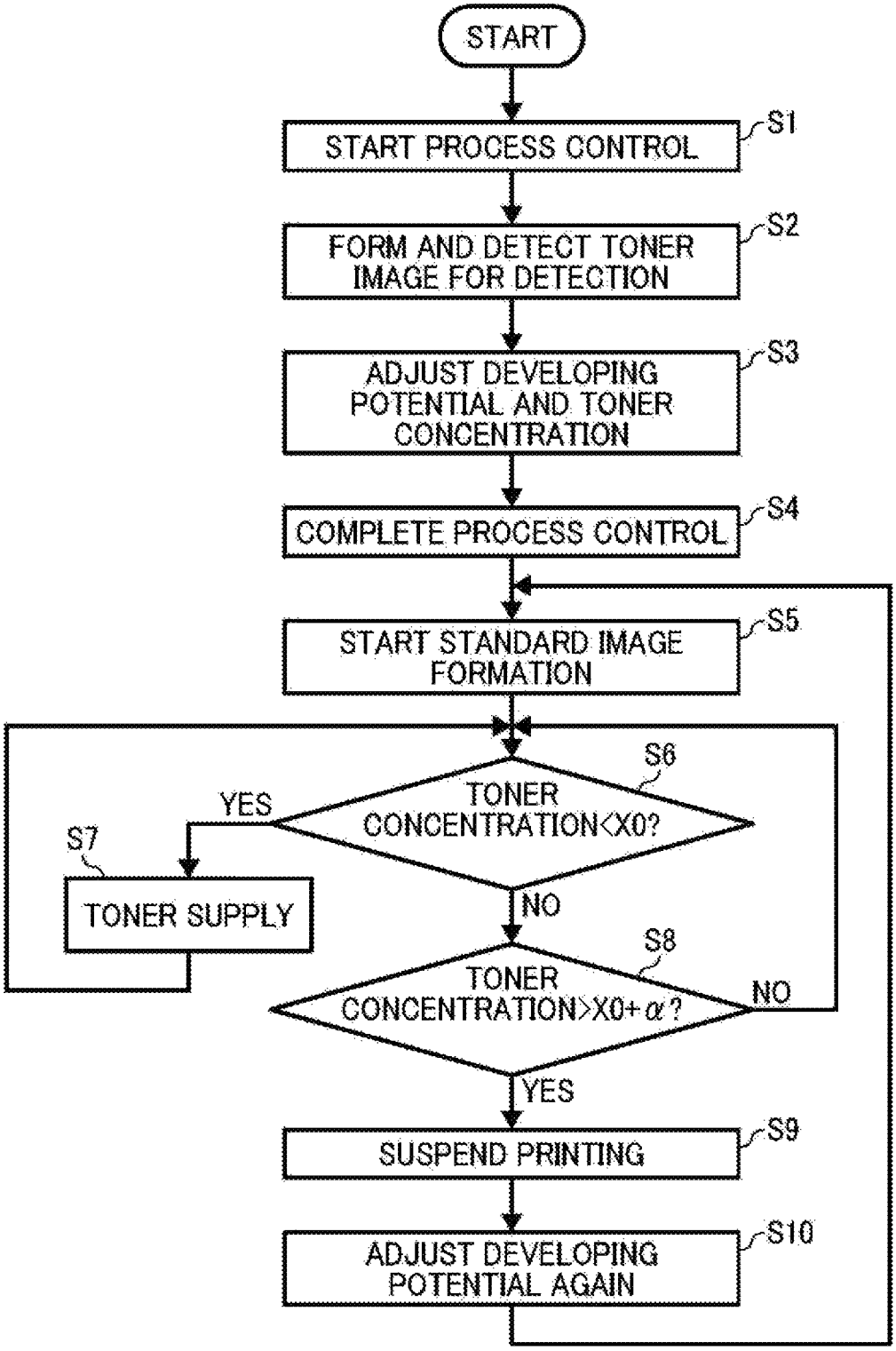
FIG. 6 is a flowchart of readjustment of the developing potential according to an embodiment.

Referring to FIG. 6, descriptions are given below of operation in the image forming apparatus 1 to readjust the developing potential as a summary.

Initially, before printing (standard image formation) is started, at S1, the controller 40 executes the process control at the predetermined timing, such as immediately after turning on of the main power. At S2, the detection toner images W (WY, WM, WC, and WBK) are formed on the surface of the intermediate transfer belt 17, and the image density detector 50 detects the image density of each detection toner image W. At S3, based on the detection result, the controller 40 adjusts the developing potential, the toner concentration TC, and the like. At S4, the controller 40 completes the process control, and standard image formation (printing operation) is started at S5.

During the printing, the magnetic sensor 13*m* constantly detects the toner concentration TC in the developer G contained in the developing device 13, and the controller 40 determines whether the current toner concentration TC is smaller than the target value X0 at S6. When the controller 40 determines that the toner concentration TC is smaller than the target value X0, the controller 40 drives the toner supply device 42 to supply toner to the toner supply device 42 at S7. Specifically, each time the accumulative printing number of sheets reaches a predetermined number (for example, ten), the detection toner images WY, WM, WC, and WBK are formed in the non-image area S of the intermediate transfer belt 17, and the image density detector 50 detects the densities of the detection toner images WY, WM, WC, and WBK. Based on the detection results generated by the image density detector 50, the controller 40 adjusts the target value X0.

During the printing, the magnetic sensor 13*m* constantly detects the toner concentration TC in the developing device 13, and the controller 40 determines whether the current toner concentration TC is higher than the target value X0 plus the threshold $\alpha$ (X0+$\alpha$) at S8. When the controller 40 determines that the current toner concentration TC is not higher than the target value X0 plus the threshold $\alpha$ (No at S8), the steps S6 through 8 are repeated until the printing operation is completed.

By contrast, when the controller 40 determines that the current toner concentration TC is higher than the target value X0 plus the threshold α (Yes at S8), the printing is suspended at S9, and the developing potential is readjusted at S10. Then, printing is resumed (at S5) with the adjusted developing potential, and the steps S6 through S10 are repeated until the printing is completed.

Here, in the procedure illustrated in FIG. 6, at S8, the controller 40 determines whether or not the toner concentration TC is higher than the target value X0 plus the threshold α to determine whether to readjust the developing potential.

Alternatively, at S8, the controller 40 can also determine whether or not the toner concentration TC is higher than a minimum value Xmin (illustrated in FIG. 5) plus a threshold β to determine whether to readjust the developing potential. That is, after the printing operation is started, when the toner concentration TC detected by the magnetic sensor 13*m* is higher than the minimum value Xmin (constantly renewed in the RAM 43) plus the threshold β (Xmin+β), the printing operation is suspended. Then, the detection toner images W are formed on the intermediate transfer belt 17, and the controller 40 readjusts the developing potential so that the image density of each detection toner image W detected by the image density detector 50 is kept at the target value Y.

Such a step is effective in the following case. As illustrated in FIG. 5, in an interval between the previous process control and the subsequent process control, it is possible that the toner concentration TC fluctuates in a range lower than the target value X0 adjusted in the previous process control and then abruptly rises, depending on the printing conditions. In such a case, in the method including comparing the difference between the target value X0 adjusted in the previous process control and the current toner concentration TC with the threshold α, it is possible that the abrupt rise of the toner concentration TC in a short period is not detected. Therefore, the image density can be more reliably kept at the preferable value by comparing the minimum value Xmin of the toner concentration TC with the current toner concentration TC and adjusting the developing potential in the process control when the difference between the minimum value Xmin and the current toner concentration TC exceeds the threshold β.

It is to be noted that the above-described threshold β is preferably from about 1.5% to 2% by weight similar to the threshold α.

Alternatively, at S8 in FIG. 6, the controller 40 can also determine whether or not an increase per unit time of the toner concentration TC exceeds a threshold γ to determine whether to readjust the developing potential. That is, after printing operation is started, when the toner concentration TC detected by the magnetic sensor 13*m* increases by the threshold γ or greater per unit time, the printing operation is suspended. Then, the detection toner images W are formed on the intermediate transfer belt 17, and the controller 40 readjusts the developing potential so that the image density of each detection toner image W detected by the image density detector 50 is kept at the target value Y.

Thus, the image density can be more reliably kept at the preferable value by executing the process control to adjust the developing potential when the increase per unit time of the toner concentration TC exceeds the threshold γ.

It is to be noted that the threshold γ is predetermined by adding a margin to the capability to charge, by stirring, the supplied toner in the developing device 13 (i.e., the rise per unit time in toner concentration).

The controller 40 according to the present embodiment can be configured to readjust the developing potential (from steps S8 through S10 in FIG. 6) when image formation is performed after printing is not executed (i.e., the apparatus is kept unused) for a predetermined time or longer under a humidity exceeding a predetermined humidity.

As described above, the toner concentration tends to increase abruptly in the printing operation after the image forming apparatus 1 is left unused under a high humidity for a long time.

Figure 7:
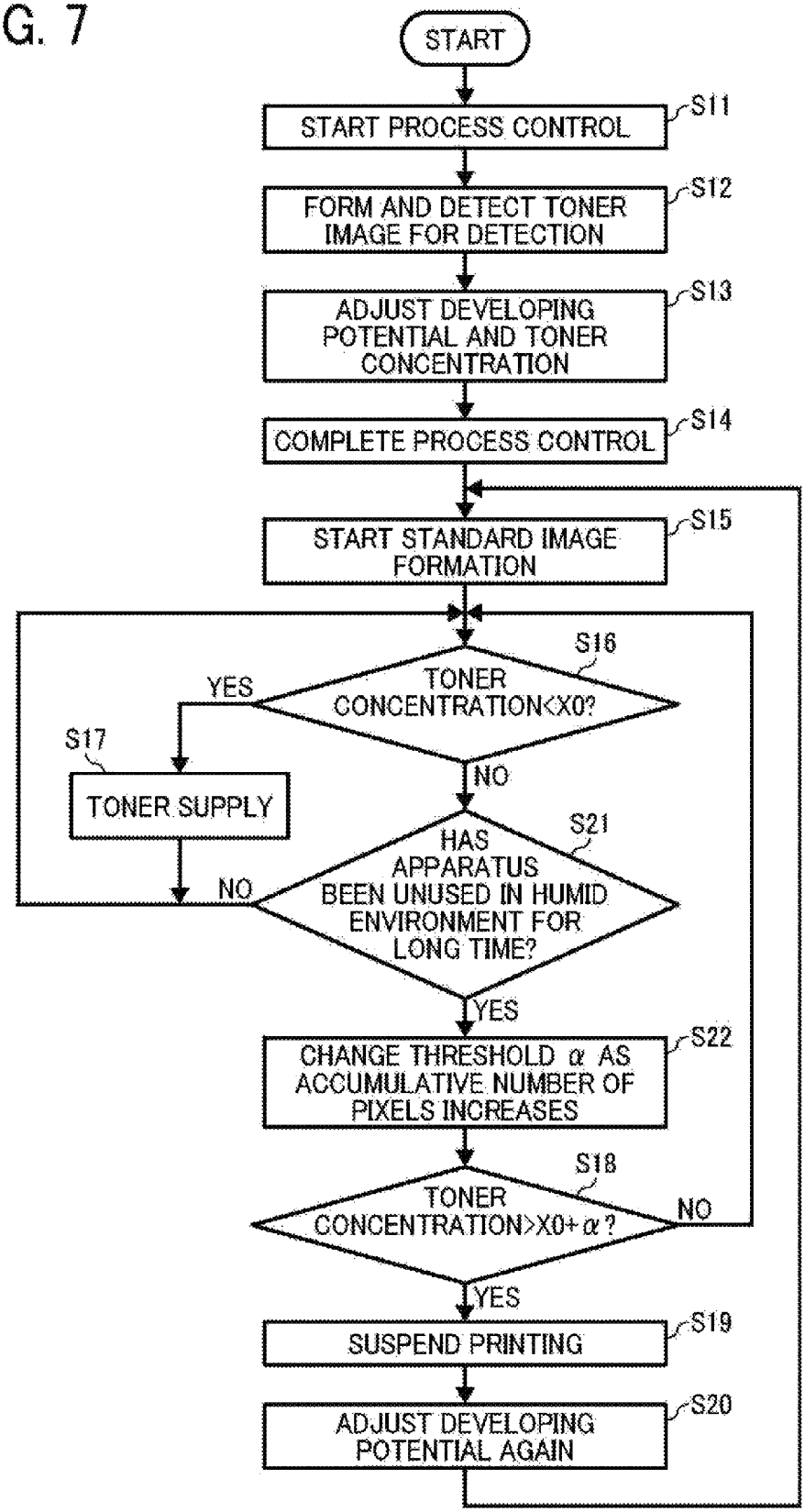
FIG. 7 is a flowchart of readjustment of the developing potential according to Variation 1.

FIG. 7 illustrates a control operation according to Variation 1, which includes determination of developing potential readjustment based on the increase per unit time in the toner concentration TC. In FIG. 7, steps S11 through S17 and S18 through S20 are similar to steps S1 to S7 and S8 through S10 in FIG. 6, and thus the descriptions thereof are omitted. Differently from the control operation illustrated in FIG. 6, at S21 in FIG. 7, the controller 40 determines whether or not the image forming apparatus 1 has been left unused in a humid environment for a long time before the start of printing. Only when the apparatus has been left unused in a humid environment for a long time (Yes at S21), at S18, the controller 40 determines whether or not the toner concentration TC is higher than the target value X0 plus the threshold α to determine whether to readjust the developing potential. Although FIG. 7 includes the step S22 before the step S18, the step S22 can be omitted. More specifically, the timer 51 (illustrated in FIG. 2) counts the image formation interval (during which printing is not executed), and the controller 40 compares the image formation interval counted by the timer 51 with a predetermined period (for example, 30 minutes). The controller 40 further compares the humidity detected by the humidity sensor 52 (illustrated in FIG. 2) with a predetermined humidity, for example, a relative humidity (RH) of 60%. When the counted image formation interval is equal to or longer than the predetermined period and the detected humidity is equal to or higher than the predetermined humidity, the controller 40 executes the steps S18 through S20.

This control operation is advantageous in avoiding unnecessary readjustment of the developing potential.

It is to be noted that the timer 51 and the humidity sensor 52 are configured to operate, receiving power from a battery disposed in the image forming apparatus 1, even when the main power of the image forming apparatus 1 is off.

Additionally, in Variation 1, when the steps S18 through S20 are performed to readjust the developing potential, the control operation can further include adjusting (in particular, increasing) the threshold α (or at least one of the thresholds α, β, and γ) as the accumulative pixel number (count increase in printing pixels) of toner images formed after the printing is started.

Although the toner in the developing device 13 absorbs moisture and decreases in chargeability while the apparatus is left unused in a humid environment for a long time, the toner having the decreased chargeability is consumed as the printing progresses, and the amount of the toner having the decreased chargeability decreases. Then, the amount of such toner (absorbing moisture and having the decreased chargeability) becomes small. At that time, as the toner is supplied to the developing device 13 and the toner concentration TC rises, the toner charge amount Q/M falls below the toner charge amount Q/M of the developer the toner supply, which is a normal phenomenon. This state inhibits the above-described inconvenience in which, even if the toner is repeatedly supplied, the decreased image density of the detection toner image W does not increase to the target value Y, resulting in the abrupt rise of the toner concentration TC.

Therefore, in FIG. 7, the accumulative number of printing pixels from the start of printing is counted, and the threshold α (or at least one of the thresholds α, β, and γ) is increased as the accumulative number of printing pixels increases. The increase in the counted printing pixel number is proportional to the consumption of toner (amount of toner discharged from the developing device 13) during the printing. Accordingly, as the increase in the counted printing pixel number becomes greater, replacement of toner in the developing device 13 is promoted, and the amount of toner absorbing moisture and having the decreased chargeability decreases.

Specifically, differently from the flow illustrated in FIG. 6, at S22 in FIG. 7, as the accumulative number of printing pixels increases, the controller 40 changes or increases the threshold α. At S18, the controller 40 determines whether or not the toner concentration TC is higher than the target value X0 plus the changed threshold α to determine whether to readjust the developing potential.

Such control operation is advantageous in efficiently inhibiting background fog and unstable image density while alleviating degradation of printing productivity.

As described above, the controller 40 according to Variation 1 readjusts the developing potential (from steps S18 through S20 in FIG. 7) when printing is performed after printing is not executed for a predetermined time or longer under a humidity exceeding the predetermined humidity. That is, only when the period during which the apparatus is unused under the humidity (e.g., absolute humidity) exceeding the predetermined humidity is longer than the predetermined period, the developing potential is readjusted based on the predetermined criteria.

Figure 8:
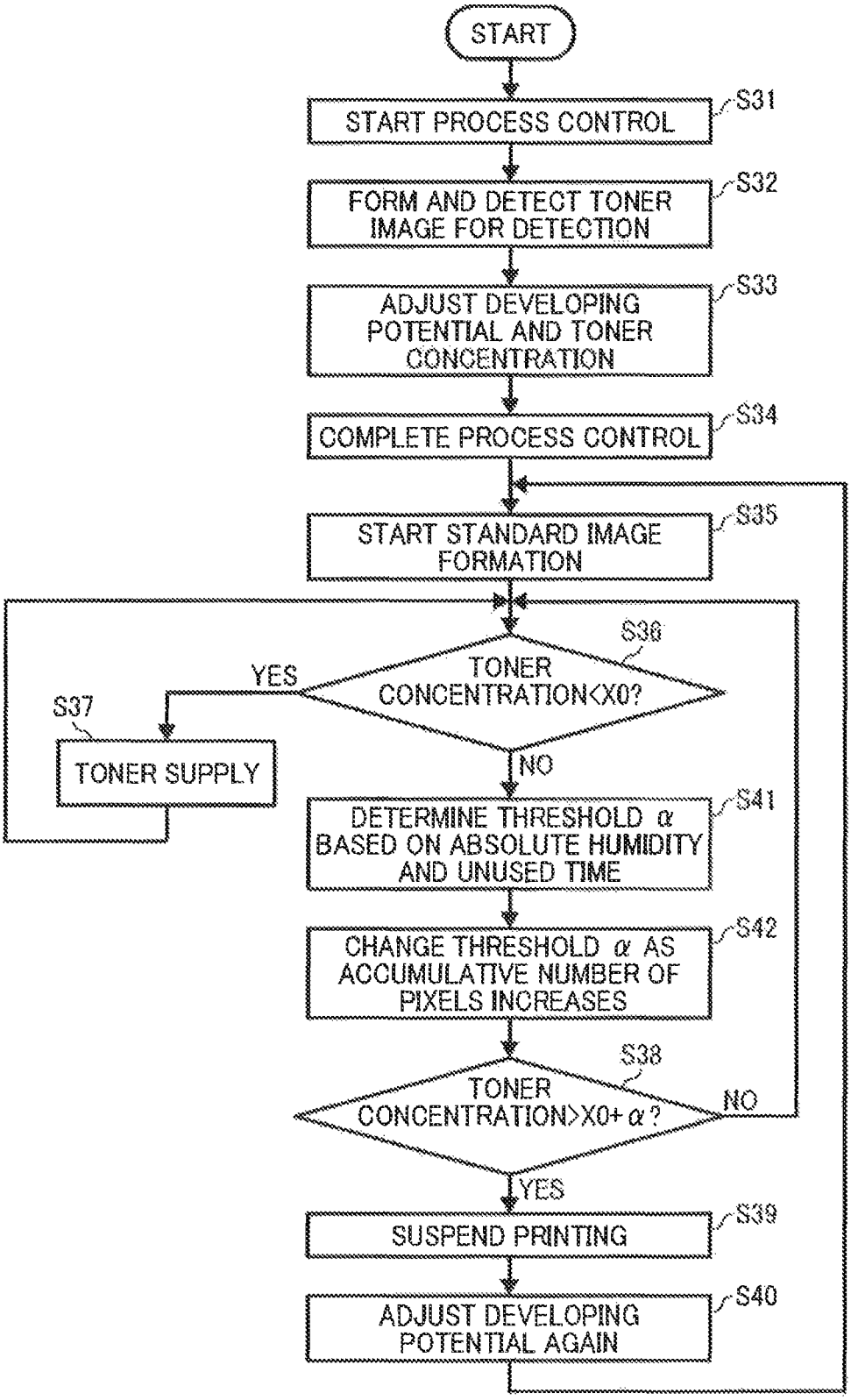
FIG. 8 is a flowchart of readjustment of the developing potential according to Variation 2.

By contrast, FIG. 8 illustrates a control operation according to Variation 2. In FIG. 8, steps S31 through S37 and S38 through S40 are similar to steps S1 to S7 and S8 through S10 in FIG. 6, and thus the descriptions thereof are omitted. In FIG. 8, the controller 40 changes the threshold α (or at least one of the thresholds α, β, and γ) based on the humidity (e.g., absolute humidity) under which the apparatus is unused and the length of image formation interval. Then, the controller 40 readjusts the developing potential based on the predetermined criteria, using the changed threshold α (or at least one of the thresholds α, β, and γ).

Specifically, the threshold α (or at least one of the thresholds α, β, and γ) is made smaller as the humidity (e.g., absolute humidity) under which the apparatus is left unused becomes higher. Additionally, the threshold α (or at least one of the thresholds α, β, and γ) is made smaller as the image formation interval during which printing is not executed becomes longer.

This is because the toner concentration tends to increase abruptly in the printing operation after the image forming apparatus 1 is left unused under a high humidity for a long time, as described above. The possibility of such phenomenon increases as the humidity and the image formation interval increase.

Specifically, differently from the control operation illustrated in FIG. 7, at S41 in FIG. 8, the controller 40 determines the threshold α (or at least one of the thresholds α, β, and γ) based on the absolute humidity during the image formation interval and the length of the image formation interval before the start of printing.

Figure 9:
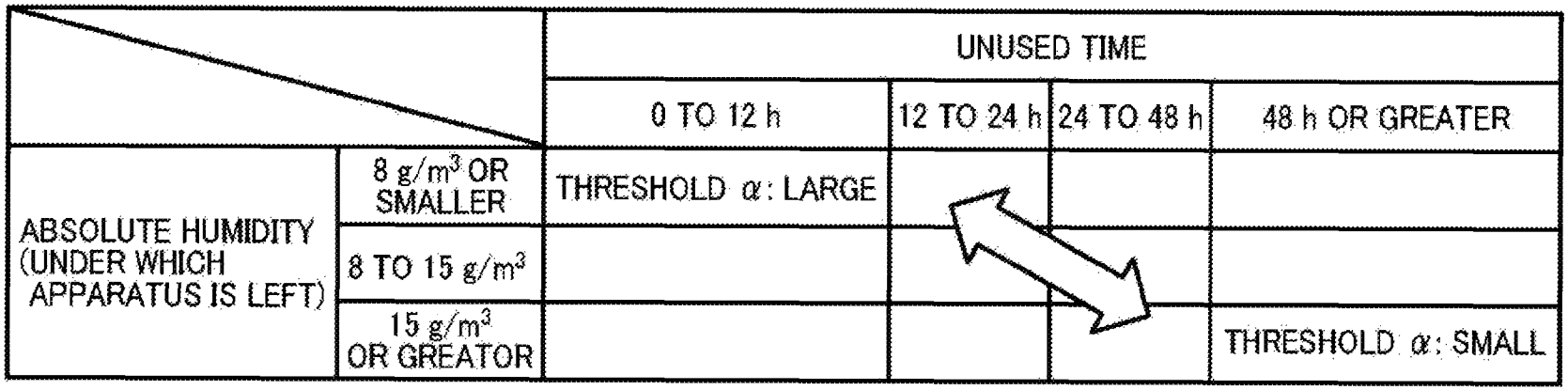
FIG. 9 is a schematic diagram of threshold setting in the readjustment illustrated in FIG. 8.

In particular, based on the time period counted by the timer 51 (illustrated in FIG. 2) disposed in the image forming apparatus 1 and the absolute humidity detected by the humidity sensor 52 (illustrated in FIG. 2), after the printing is started, the computation part of the controller 40 sets the threshold α according to a setting table, for example, that illustrated in FIG. 9, stored in the controller 40. The setting table illustrated in FIG. 9 includes three ranges of absolute humidity, namely, 8 g/m$^3$ or smaller, from 8 g/m$^3$ to 15 g/m$^3$, and 15 g/m$^3$ or greater, and four ranges of image formation interval, namely, zero to 12 hours, 12 to 24 hours, 24 to 48 hours, and 48 hours or greater. In accordance with the combination of the absolute humidity range and the image formation interval range, the magnitude of the threshold α is predetermined. As illustrated in FIG. 9, the threshold α decreases as the absolute humidity increases. The threshold α also decreases as the image formation interval becomes longer. In short, the threshold α decreases as the multiplication of absolute humidity with image formation interval increases.

Then, at S38 in FIG. 8, the controller 40 determines whether or not the toner concentration TC is higher than the target value X0 plus the changed threshold α and determines whether or not to readjust the developing potential.

This control operation is advantageous in avoiding unnecessary readjustment of the developing potential. The background fog and unstable image density can be efficiently inhibited.

It is to be noted that, also in the case where the threshold α (or at least one of the thresholds α, β, and γ) is changed to a suitable value based on the humidity under which the apparatus is left unused and the length of image formation interval, when the developing potential is adjusted (in the steps S38 through S40), the control operation can further include adjusting (in particular, increasing) the threshold α (or at least one of the thresholds α, β, and γ) in accordance with increases in the accumulative pixel number (count increase in printing pixels) of toner images formed after the printing is started.

Specifically, at S42 in FIG. 7, as the accumulative number of printing pixels increases, the controller 40 increases the threshold α from the threshold α determined at S41. At S38, the controller 40 determines whether or not the toner concentration TC is higher than the target value X0 plus the changed threshold α to determine whether to readjust the developing potential.

Such control operation is advantageous in efficiently inhibiting background fog and unstable image density while alleviating degradation of printing productivity.

According to the above-described embodiment and Variations 1 and 2, after the standard printing operation is started, while the toner concentration TC is adjusted, the printing operation is suspended when the toner concentration TC detected by the magnetic sensor 13*m* is higher than the target value X0 by the threshold α (X0+α) or greater. Then, the detection toner images W are formed on the surface of the intermediate transfer belt 17 (the intermediate transfer member), and the controller 40 readjusts the developing potential so that the image density of each detection toner image W (WY, WM, WC, and WBK) detected by the image density detector 50 is kept at the target value Y.

Such control operation is advantageous in inhibiting the occurrences of background fog on the surface of the photoconductor drum 11 (image bearer) and unstable image density even when the image forming apparatus 1 is left unused in a humid environment for a long time.

It is to be noted that, in the description above, the second conveying screw 13*b*2 serving as a collecting screw is disposed above the first conveying screw 13*b*1 serving as the supply screw, and the doctor blade 13*c* is disposed below the developing roller 13*a*. However, the various aspects of the present disclosure are not limited to the above-described developing device 13 but are also applicable to any developing device employing two-component developing. For example, in another embodiment, the second conveying screw 13*b*2 serving as the collecting screw is disposed below the first conveying screw 13*b*1 serving as the supply screw, and the doctor blade 13*c* is disposed above the developing roller 13*a*. Additionally, the aspects of the present disclosure are applicable to developing devices employing two-component developing and including multiple conveying screws arranged in a horizontal direction not in the vertical direction. For example, JP-2014-149487-A and 2013-97358-A disclose such developing devices.

In such configurations, effects similar to those described above are also attained.

Additionally, although the description above concerns the developing device 13 configured as a unit removably installable in the body of the image forming apparatus 1, alternatively, one or more of the components of the image forming station can be united together as a process cartridge removably installable in the body of the image forming apparatus 1. When the image forming station is configured as the process cartridge, maintenance work can be facilitated.

It is to be noted that the term "process cartridge" used in the present disclosure means a unit including an image bearer and at least one of a charging device, a developing device, and a cleaning device housed in a common unit casing and designed to be removably installed together in the body of the image forming apparatus.

Although the description above concerns the multicolor image forming apparatus 1 including the intermediate transfer belt 17 serving as the intermediate transfer member, the aspects of the present disclosure can adapt to a monochrome or multicolor image forming apparatus in which an image is transferred from an image bearer onto a recording medium directly. In such a case, the image density detector is disposed facing the surface of the image bearer (the photoconductor drum) to detect the image density of the detection toner image on the image bearer.

Yet additionally, although the magnetic sensor 13*m* is used as the toner concentration detector in the description above, alternatively, the toner concentration detector can be a detector to optically detect the image density of the toner image on the photoconductor drum 11, thereby indirectly detecting the toner concentration of developer inside the developing device. In such configurations, effects similar to those described above are also attained.

Further, any one of the above-described and other example features of the present disclosure may be embodied in the form of method, system, computer program, and computer program product. For example, the aforementioned methods may be embodied in the form of a system or device, including, but not limited to, any of the structure for performing the methodology illustrated in the drawings.

The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. An image forming apparatus comprising:

an image bearer;

an image forming device including a developing device to develop, with a developer including a toner and a carrier, a latent image on a surface of the image bearer into a detection toner image, the developing device including a developer bearer disposed facing the image bearer, the developer bearer to bear the developer;

a toner concentration detector to detect a toner concentration of the developer in the developing device;

a toner supply device to supply the toner to the developing device;

an image density detector disposed facing the surface of the image bearer to detect an image density of the detection toner image on the surface of the image bearer; and a controller including a memory device to store a target concentration for the toner concentration and a target density for the image density of the detection toner image, wherein, at a predetermined adjustment timing before image formation is started, the controller causes the image forming device to form the detection toner image on the surface of the image bearer, adjusts a developing potential, which is a difference between a developing bias applied to the developer bearer and a latent image potential on the image bearer, to keep the image density of the detection toner image detected by the image density detector at the target density, and drives at least one of the toner supply device and the developing device to keep the toner concentration detected by the toner concentration detector at the target concentration, wherein, after the image formation is started, the controller drives the toner supply device to keep the detected toner concentration at the target concentration, wherein, at a predetermined sheet interval timing after the image formation is started, the controller causes the image forming device to form the detection toner image in a non-image area on the surface of the image bearer, adjusts the target concentration based on the detected image density of the detection toner image, and controls the toner concentration based on the adjusted target concentration, and wherein, when the detected toner concentration is higher than the target concentration plus a threshold, the controller suspends the image formation, causes the image forming device to form the detection toner image on the surface of the image bearer, and readjusts the developing potential to keep the detected image density of the detection toner image at the target density.

2. The developing device according to claim 1, further comprising:

a timer to count an image formation interval during which image formation is not executed; and a humidity sensor to detect an ambient humidity, wherein the controller readjusts the developing potential before image formation is started in a case where the counted image formation interval is longer than a predetermined period and the ambient humidity detected by the humidity sensor during the counted image formation interval exceeds a predetermined humidity.

3. The developing device according to claim 1, further comprising a humidity sensor to detect an ambient humidity during an image formation interval during which image formation is not executed, wherein the controller sets the threshold to a reduced value as the ambient humidity in the image formation interval increases.

4. The developing device according to claim 1, further comprising a timer to count an image formation interval during which image formation is not executed, wherein the controller sets the threshold to a reduced value as the image formation interval counted by the timer increases.

5. The developing device according to claim 1, wherein, in readjusting the developing potential, the controller sets the threshold to an increased value as an accumulative pixel number of toner images formed after the image formation is started increases.

6. The developing device according to claim 1, wherein the image bearer includes:

a latent image bearer; and an intermediate transfer member, wherein the image forming device further includes:

a writing device to form a latent image on the latent image bearer according to image data; and a transfer device to transfer a toner image from the latent image bearer onto the intermediate transfer member, and wherein the image density detector is disposed facing a surface of the intermediate transfer member to detect the image density of the detection toner image on the intermediate transfer member.

7. An image forming apparatus comprising:

an image bearer;

an image forming device including a developing device to develop, with a developer including a toner and a carrier, a latent image on a surface of the image bearer into a detection toner image, the developing device including a developer bearer disposed facing the image bearer, the developer bearer to bear the developer;

a toner concentration detector to detect a toner concentration of the developer in the developing device;

a toner supply device to supply the toner to the developing device;

an image density detector disposed facing the surface of the image bearer to detect an image density of the detection toner image on the surface of the image bearer; and a controller including a memory device to store a target concentration for the toner concentration, a target density for the image density of the detection toner image, and a minimum value of the detected toner concentration after image formation is started, wherein, at a predetermined adjustment timing before image formation is started, the controller causes the image forming device to form the detection toner image on the surface of the image bearer, adjusts a developing potential, which is a difference between a developing bias applied to the developer bearer and a latent image potential on the image bearer, to keep the image density of the detection toner image detected by the image density detector at the target density, and drives at least one of the toner supply device and the developing device to keep the detected toner concentration at the target concentration, wherein, after the image formation is started, the controller drives the toner supply device to keep the detected toner concentration at the target concentration, wherein, at a predetermined sheet interval timing after the image formation is started, the controller causes the image forming device to form the detection toner image in a non-image area on the surface of the image bearer, adjusts the target concentration based on the detected image density of the detection toner image, and controls the toner concentration based on the adjusted target concentration, and wherein, when the detected toner concentration is higher than the minimum value of the toner concentration plus a threshold, the controller suspends the image formation, causes the image forming device to form the detection toner image on the surface of the image bearer, and readjusts the developing potential to keep the detected image density of the detection toner image at the target density.

8. An image forming apparatus comprising:

an image bearer;

an image forming device including a developing device to develop, with a developer including a toner and a carrier, a latent image on the image bearer into a detection toner image, the developing device including a developer bearer disposed facing the image bearer, the developer bearer to bear the developer;

a toner concentration detector to detect a toner concentration of the developer in the developing device;

a toner supply device to supply the toner to the developing device;

an image density detector disposed facing a surface of the image bearer to detect an image density of the detection toner image on the surface of the image bearer; and a controller including a memory device to store a target concentration for the toner concentration and a target density for the image density of the detection toner image, wherein, at a predetermined adjustment timing before image formation is started, the controller causes the image forming device to form the detection toner image on the surface of the image bearer, adjusts a developing potential, which is a difference between a developing bias applied to the developer bearer and a latent image potential on the image bearer, to keep the image density of the detection toner image detected by the image density detector at the target density, and drives at least one of the toner supply device and the developing device to keep the detected toner concentration at the target concentration, wherein, after the image formation is started, the controller drives the toner supply device to keep the detected toner concentration at the target concentration, wherein, at a predetermined sheet interval timing after the image formation is started, the controller causes the image forming device to form the detection toner image in a non-image area on the surface of the image bearer, adjusts the target concentration based on the detected image density of the detection toner image, and controls the toner concentration based on the adjusted target concentration, and wherein, when an increase per unit time in the detected toner concentration is greater than a threshold, the controller suspends the image formation, causes the image forming device to form the detection toner image on the surface of the image bearer, and readjusts the developing potential to keep the detected image density of the detection toner image at the target density.

* * * * *